US008613626B1

(12) United States Patent
Phan

(10) Patent No.: US 8,613,626 B1
(45) Date of Patent: Dec. 24, 2013

(54) DUAL LEVEL CONTACT DESIGN FOR AN INTERCONNECT SYSTEM IN POWER APPLICATIONS

(75) Inventor: Eric N. Phan, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/529,603

(22) Filed: Jun. 21, 2012

(51) Int. Cl.
*H01R 13/53* (2006.01)

(52) U.S. Cl.
USPC ..... 439/181; 439/268

(58) Field of Classification Search
USPC ..... 439/181, 268, 520
See application file for complete search history.

(56) References Cited

U.S. PATENT DOCUMENTS

| | | | | |
|---|---|---|---|---|
| 2,203,973 | A * | 6/1940 | Walls | 439/848 |
| 4,747,783 | A | 5/1988 | Bellamy et al. | |
| 5,135,417 | A * | 8/1992 | Stanevich | 439/851 |
| 5,176,528 | A | 1/1993 | Fry et al. | |
| 5,681,190 | A | 10/1997 | Childs | |
| 6,257,911 | B1 * | 7/2001 | Shelby et al. | 439/268 |
| 6,537,091 | B2 | 3/2003 | Hirai et al. | |
| 6,753,624 | B2 | 6/2004 | Miwa | |
| 6,790,101 | B1 * | 9/2004 | Data et al. | 439/851 |
| 7,467,960 | B1 | 12/2008 | Harlan et al. | |
| 7,677,929 | B2 | 3/2010 | Bradford-Stagg | |
| 7,874,844 | B1 | 1/2011 | Fitts, Jr. | |
| 7,878,859 | B2 * | 2/2011 | Zhu | 439/638 |
| 2002/0102887 | A1 | 8/2002 | Watanabe | |
| 2007/0128946 | A1 * | 6/2007 | Hisamatsu et al. | 439/638 |
| 2009/0104818 | A1 * | 4/2009 | Wu et al. | 439/638 |
| 2010/0022137 | A1 * | 1/2010 | McAlonis et al. | 439/638 |
| 2010/0273339 | A1 | 10/2010 | Chen | |

FOREIGN PATENT DOCUMENTS

DE 202010001601 6/2011

OTHER PUBLICATIONS

Spergel J. et al., "New Rugged Multicontact Connectors", Mar. 1958, IRE Transactions on Component Parts, vol. 5, issue 1, 60-67.

* cited by examiner

*Primary Examiner* — Neil Abrams
*Assistant Examiner* — Phuongchi T Nguyen
(74) *Attorney, Agent, or Firm* — Fleit Gibbons Gutman Bongini & Bianco PL; Thomas Grzesik

(57) ABSTRACT

Various embodiments provide an interconnect system for power applications. The interconnect system includes a receptacle comprising a first conductive wall. At least a second conductive wall is situated opposite the first conductive wall. The receptacle further includes a first end and a second end situated opposite the first end. A first sacrificial contact area is situated on the first conductive wall. At least a second sacrificial contact area is situated on the second conductive wall. A first conductive contact area is situated on the first conductive wall. At least a second conductive contact area is situated on the second conductive wall. The conductive contact areas are situated closer to the first end than the sacrificial contact areas. The sacrificial contact areas are configured to contact a sacrificial portion of the header prior to a conductive portion of the header contacting the conductive contact areas of the receptacle.

25 Claims, 5 Drawing Sheets

DUAL LEVEL CONTACT DESIGN FOR AN INTERCONNECT SYSTEM IN POWER APPLICATIONS

BACKGROUND

The present invention generally relates to interconnect systems, and more particularly relates an interconnect system for power applications.

Electrical connectors are used to transfer data and/or power between components in computer systems. Power connectors, specifically, are used to make power connections to components in computer systems. A power connector commonly includes a plurality of tail terminals on the back of the connector for assembling the power connector to a printed circuit board (PCB), such as a motherboard in a PC or server, or a midplane or backplane in the chassis of a blade server system. The power connector also typically includes exposed pins or receptacles that are used to connect with a mating power connector on a component to be connected. Electrical power is transferred along electrical pathways on the PCB from a power source to the tail terminals, from the tail terminals to the exposed pins or receptacles, and from the exposed pins or receptacles to the mating connector on the connected component, for supplying power to the connected component.

A blade server system is one example of a computer system that uses numerous power connectors to supply power from a power module to multiple servers in a high-density arrangement. A relatively large amount of power is distributed from the power supply to the servers at a high voltage. As the pin/header of one power connector engages the receptacle of the other power connector the difference in voltage can generate a spark between the header and the receptacle. The heat generated by the spark generally leaves carbon deposits (burn surfaces) on the pin and/or the receptacle resulting in high contact resistance. The damaged pin or receptacle will no longer be able to transfer the same amount of power it is designed to carry, which leads to power being distributed to the remaining pins and receptacles and could overheat and burn the connector and PCB cards. which result in damage of the interconnects and/or the blade server system and its components. Also, the heat generated by the spark can also cause the header and the receptacle to fuse together over a period of time. Therefore, when the header is attempted to be removed from the receptacle the interconnects can be damaged.

BRIEF SUMMARY

In one embodiment, a receptacle for a power interconnect system is disclosed. The receptacle comprises a first conductive wall and at least a second conductive wall situated opposite to the first conductive wall. The receptacle also comprises a first end and a second end situated opposite to the first end. The first end is configured to receive a corresponding header of a connector. A first sacrificial contact area is situated on the first conductive wall. At least a second sacrificial contact area is situated on the second conductive wall and opposite to the first sacrificial contact area. A first conductive contact area is situated on the first conductive wall. At least a second conductive contact area is situated on the second conductive wall and opposite to the first conductive contact area. A distance between the first end and the first and second conductive contact areas is less than a distance between the first end and the first and second sacrificial contact areas. The first and second sacrificial contact areas are configured to contact a sacrificial portion of the header prior to a conductive portion of the header contacting the first and second conductive contact areas of the receptacle.

In another embodiment, a header for a power interconnect system is disclosed. The header comprises a first portion comprising a first width. A second portion comprises a second width, A third portion is situated between the first and second portions, and comprises a third width, The first width is less than the second width and greater than the third width. The third width is less than the first width and the second width. The first portion is configured to contact a first contact area of a receptacle of a connector prior to the second portion contacting a second contact area of the receptacle. The first contact area of the receptacle is situated further from an opening of the receptacle than the second contact area.

In yet another embodiment, an interconnect system for power applications is disclosed. The interconnect system comprises at least one header and at least one receptacle configured to engage the at least one header. The header comprises a first portion, a second portion, and a third portion situated between the first and second portions. The receptacle comprises a first conductive wall and at least a second conductive wall situated opposite from the first conductive wall. The receptacle also comprises a first end and a second end situated opposite from the first end. The first end is configured to receive the header. A first sacrificial contact area is situated on the first conductive wall. At least a second sacrificial contact area is situated on the second conductive wall and opposite to the first sacrificial contact area. A first conductive contact area is situated on the first conductive wall. At least a second conductive contact area is situated on the second conductive wall and opposite the first conductive contact area. The first portion of the header is configured to contact the first and second sacrificial contact areas of the receptacle prior to the second portion of the header contacting the first and second conductive contact areas. A distance between the first end and the first and second conductive contact areas is less than a distance between the first end and the first and second sacrificial contact areas.

In another embodiment, an interconnect system for power applications is disclosed. The interconnect system comprises at least one connector comprising a housing. The housing comprises at least one receptacle. The receptacle comprises a first conductive wall and at least a second conductive wall situated opposite to the first conductive wall. The receptacle also comprises a first end and a second end situated opposite to the first end. The first end is configured to receive a corresponding header of a connector. A first sacrificial contact area is situated on the first conductive wall. At least a second sacrificial contact area is situated on the second conductive wall and opposite to the first sacrificial contact area. A first conductive contact area is situated on the first conductive wall. At least a second conductive contact area is situated on the second conductive wall and opposite to the first conductive contact area. A distance between the first end and the first and second conductive contact areas is less than a distance between the first end and the first and second sacrificial contact areas. The first and second sacrificial contact areas are configured to contact a sacrificial portion of the header prior to a conductive portion of the header contacting the first and second conductive contact areas.

BRIEF DESCRIPTION OF THE SEVERAL VIEWS OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

Figure 1:
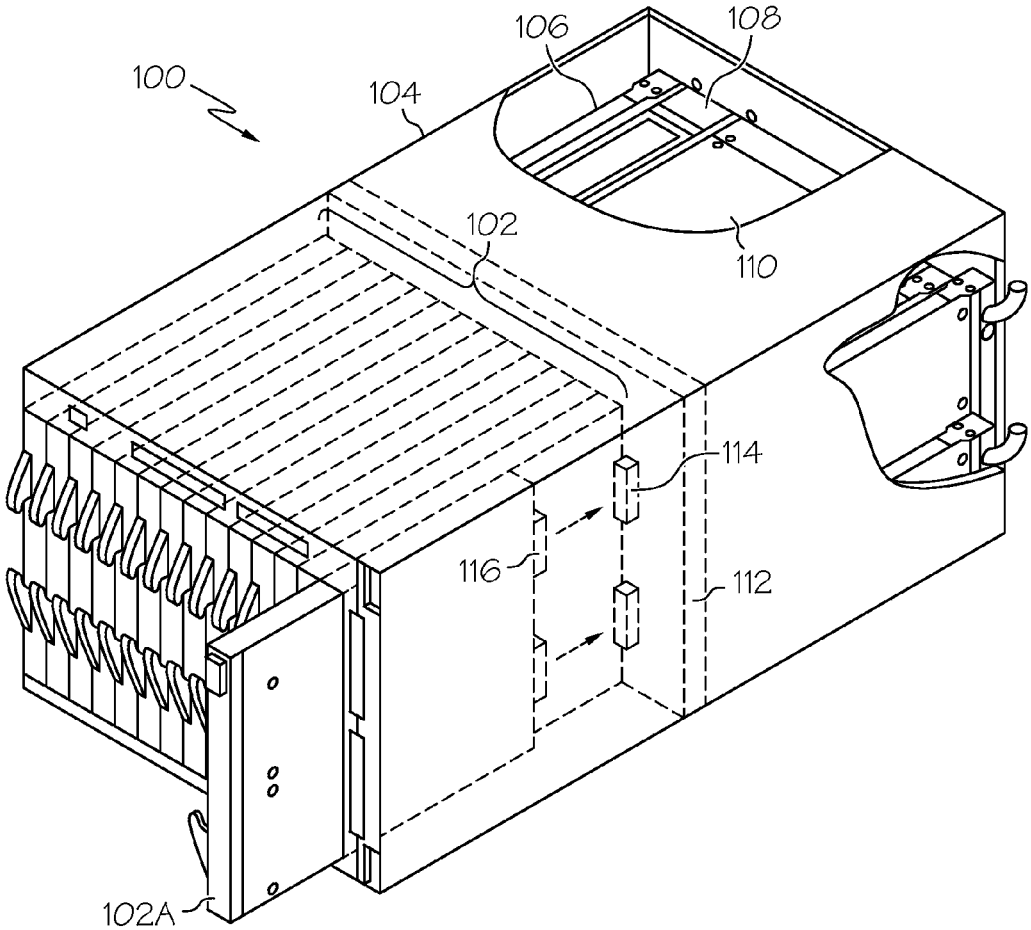
FIG. 1 illustrates one example of an environment in which an interconnect system can be implemented according to one embodiment of the present invention.

One or more embodiments provide an interconnect system comprising dual level contacts. The interconnect system of one or more embodiments is applicable to various environments in which an electrical component is coupled to another electrical component for receiving power. One non-limiting example of such an environment is a blade server system 100 as shown in FIG. 1. In particular, FIG. 1 is a perspective view of an example blade server system 100 including a plurality of blade servers 102 removably installed in a rack-mountable blade server chassis 104. The blade server chassis 104 houses a plurality of blade servers 102. The blade servers 102 share system resources such as power, cooling, and network connectivity provided by various chassis support modules. The chassis support modules include at least one each of a chassis management module 106, a power supply module 108, and a blower module 110.

The management module 106 manages the hardware installed in the chassis 104, including the blade servers 102, power supply module 108, and blower module 110. The power module 106 provides electrical power to all of the blade servers 102. The blower module 110 generates airflow through the chassis 104 to remove the heat generated by each of the servers 102 and support modules. The blade servers 102 and support modules 106, 108, 110 interface with one another within the blade server chassis 104 by virtue of their connection with a chassis midplane 112. The midplane 112, in one example, is a printed circuit board (PCB) having a first set rigid connectors at each chassis bay for the servers 102 to blind-dock using a second set of rigid connectors. FIG. 1 shows one of the blade servers 102A as being only partially inserted within its bay, to reveal the first set of rigid power connectors 114 formed on the midplane 112 in a position aligned for blind-docking the server 102A using the second set of rigid connectors 116 disposed thereon. The first and second set of rigid connectors 114, 116 (and their components discussed below) are herein referred to as the "interconnect system".

One problem with conventional interconnect systems is that they generally comprise only a single level contact area. Therefore, as a header is inserted into a receptacle of the interconnect system the contact areas of the header and receptacle can be easily damaged from sparking and overheating. For example, burning and/or gold plating quality degradation can occur as a result of the voltage differential between the header and receptacle at initial contact. This can result in the header welding to the receptacle or increased resistance of the interconnect system.

The interconnect system of one or more embodiments overcome these problems by providing dual level contacts. As will be discussed in greater detail below the interconnect system comprises one or more header components and one or more receptacle components for receiving/engaging the headers. Each of the headers and receptacles can be situated within a respective connector housing. The header component(s) comprises one or more sacrificial contact areas and one or more conductive areas. As the header component is inserted into the receptacle the sacrificial contact area(s) of a header initially contacts one or more sacrificial contact areas of the receptacle to equalize the voltage between therebetween. This initial contact occurs prior to a conductive contact area of the header contacting/engaging a conductive contact area of the receptacle. Therefore, any sparking or overheating occurs at the sacrificial contact areas as compared to occurring at the conductive contact areas. As the header transitions further into the receptacle the sacrificial contact areas remain in contact as the conductive contacts areas of the header and receptacle contact each other. This maintains the voltage levels between the header and receptacle to prevent any sparking or overheating at the conductive contact areas. As the header continues to transition into the receptacle the sacrificial contact areas disengage and the conductive contact areas remain in contact in a working/operating position. Therefore, any damage experienced at the sacrificial contact areas do not adversely affect the power connectors and/or the components comprising the power connectors.

Figure 2:
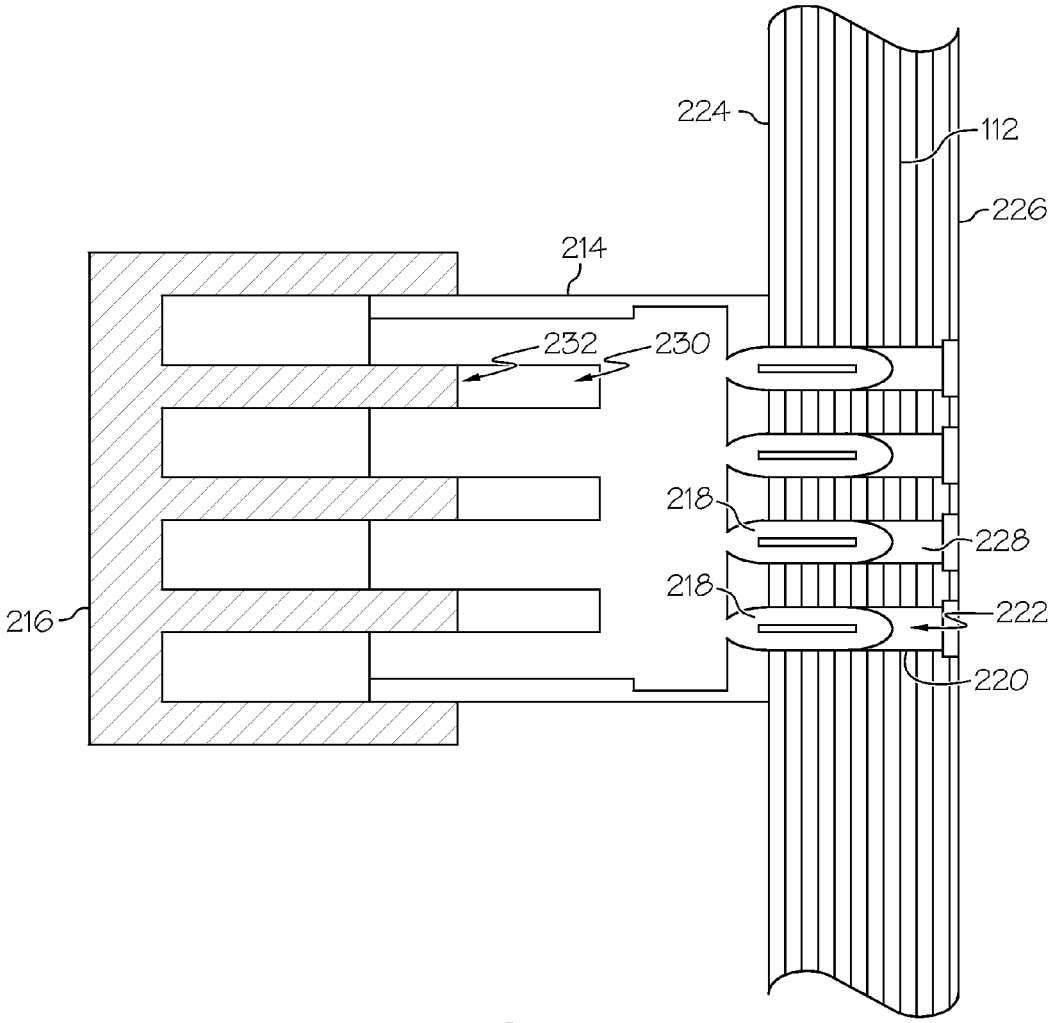
FIG. 2 is a cross-sectional side view of an interconnect system according to one embodiment of the present invention.

FIG. 2 is a sectioned view of a first rigid power connector 214 of the interconnect system assembled onto the midplane 112. FIG. 2 also shows a sectioned view of a second rigid power connector 216 of the interconnect system situated on a blade server 102. The second power connector 116 is partially coupled to the first rigid connector 214. The first rigid power connector 214 includes a plurality of compliant pins 218. The midplane 112 has a plurality of vias 220 for receiving the compliant pins 218. Vias, generally, are plated through-holes whose uses include making electrical connections between different layers of a PCB, such as between traces on one plane of the PCB with traces on another layer of the PCB. Here, the vias 220 include through holes 222 that pass through the midplane 112 from a first surface 224 to an opposing second surface (referred to as the "backside" in this example) 226. An electrically conductive material layer 228 may be formed in the through-holes 222 by electroplating, or by filling the through-holes 222 with annular rings or rivets. The vias 220 are electrically coupled to the power supply module 108.

The first rigid connector 214 comprises one or more receptacles 230 for receiving/engaging one or more header (mating) components 232 of the first rigid connector 214. When a header 232 is inserted into a receptacle 230 the receptacle 230 electrically couples the header 232 to the power supply module 108. It should be noted that, in another embodiment, the second rigid connector 216 comprises one or more receptacles 230 while the first rigid connector 214 comprises one or more header components 232. Also, each of the rigid connectors 214, 216 can comprise corresponding combinations of receptacles 230 and header components 232. It should also be noted that the dimensions, architecture, and components of the rigid connectors 214, 216 shown in FIG. 2 are illustrative only and do not limit the embodiments in any way.

Figure 3:
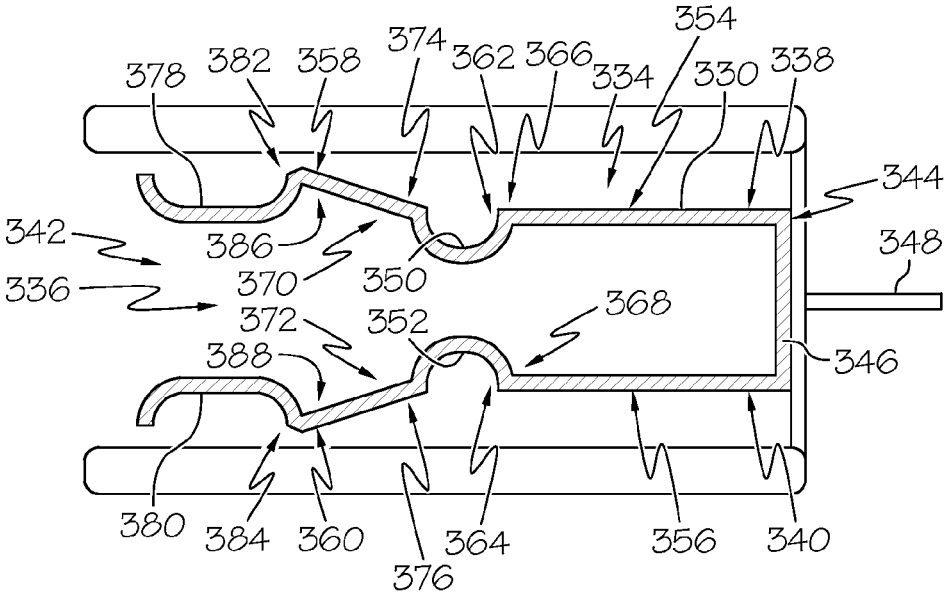
FIG. 3 is a side view of a receptacle component of an interconnect system according to one embodiment of the present invention.

FIGS. 3 to 7 show a more detailed view of the receptacle and header components of the interconnect system of FIG. 2 according to one or more embodiments. In particular, FIG. 3 is a cross-sectional side view of a portion of a rigid connector. FIG. 3 shows a receptacle 330 being situated within a via 334 of the first rigid connector 214 for receiving and electrically coupling a header 432 shown in FIG. 4 to the power supply module 108. It should be noted that the receptacle 330 is not required to be situated within a via 334. The receptacle 330 comprises a cavity 336 defined by a first wall 338 and at least a second wall 340 situated opposite from the first wall 338. It should be noted that the first wall 336 and the second wall 338 can be separate or part of a single continuous wall (e.g., a cylindrical wall). In one embodiment implementing a single continuous wall, the first wall 338 and the second wall 340 are first and second portions, respectively, of the continuous wall. It should be noted that each of the components of the receptacle 330 discussed below can be situated on or formed as part of the conductive walls 338, 340.

The receptacle comprises a first end 342 and a second end 344. The first end 342 is open for receiving a corresponding header 432. The second end 344, in one embodiment, comprises an optional third wall 346 that is perpendicular to the first and second walls 338, 340 and abuts each of the first conductive wall 338 to the second conductive wall 340. The third wall 346 (or any other portion of the receptacle 330) can be mechanically coupled to the via 334 for securing the receptacle 330 within the via 334. In another embodiment, one or more portions of the receptacle 330 can be formed as part of the via 334. Also, one or more portions of the first and second walls 338, 336 can configured to exert a force against the via walls to secure the receptacle 330 therein. In one embodiment, the third wall 346 (or any other portion of the receptacle 330) is electrically coupled via one or more electrical pathways 348 to the power supply module 108. Alternatively, the via 334 itself can be coupled to the power supply module 108 and electrically coupled the receptacle 330 thereto.

In one embodiment the first wall 338 comprises a first sacrificial contact area/member 350. In this embodiment the second wall 340 comprises a second sacrificial contact area/member 352. These sacrificial contact areas 350, 352 are configured to be the initial (i.e., a first) contact point for the header 432 in the dual-level contact design of the interconnect system. In one embodiment, the first and second sacrificial contact areas 350, 352 are situated opposite each other. In another embodiment, the first and second sacrificial contact areas 350, 352 are part of a single sacrificial contact area. The first and second sacrificial contact areas 350, 352 are situated between and abut (or be coupled to) to a first portion 354, 356 and second portion 358, 360 of each of the first and second walls 338, 340, respectively. For example, a first end 362, 364 of the sacrificial contact areas 350, 352 abut (or is coupled to) a first end 366, 368 of the first portion 354, 356 of the walls 338, 340. A second end 370, 372 of the first and second sacrificial contact areas 350, 352 abut (or is coupled to) a first end 374, 376 of the second portion 358, 360 of the walls 338, 340. In one embodiment, the first and second portions 354, 356 of the walls 338, 340 are parallel to each other, but are not required to be parallel.

The first and second sacrificial contact areas 350, 352 extend/curve inward towards the cavity 336 and each other. In one embodiment, the first and second sacrificial contact areas 350, 352 are configured to flex/pivot outwards (away from the cavity) as a portion of the header 432 contacts and passes between the first and second sacrificial contact areas 350, 352. In this embodiment, the first portions 354, 356 of the first and second walls 338, 340 are flexible and flex outward away from the cavity 336 as the header 342 exerts a force against the sacrificial contact areas 350, 352. In another embodiment, the sacrificial contact areas 350, 352 can be pivotably coupled to the first portion 354, 356 of the second walls 338, 340, respectively. In this embodiment, the first ends 362, 364 of the sacrificial contact areas 350, 352 are pivotably coupled to the first ends 366, 368 of the walls 338, 340, respectively. This allows the sacrificial contact areas 350, 352 to pivot outward away from the cavity 336 as the header component exerts a force against the first and second sacrificial contact areas 350, 352.

The receptacle 330 also includes a first conductive contact area/member 378 situated on the first wall 338 and second conductive contact area/member 380 situated on the second wall 340. The conductive contact areas 378, 380 form the first end 342 of the receptacle 330. In one embodiment, a first end 382, 384 of the conductive contact areas 378, 380 abuts/contacts (or is coupled to) the second end 386, 388 of the second portion 358, 360 of the first and second walls 338, 340. In this configuration, the second portion 358, 360 of the walls 338, 340 is disposed between the conductive contact areas 378, 380 and the sacrificial contact areas 350, 352. In one embodiment, the second portion 358, 360 of the walls 338, 340 is angled away from the cavity 336 starting at the second end 370, 372 of the sacrificial contact areas 350, 352 such that the distance between the conductive contact areas 378, 380 is greater than the distance between the sacrificial contact areas 350, 352. It should be noted that in one embodiment the distance between the sacrificial contact areas 350, 352 is also less than the distance between the first portion 354, 356 of the walls 338, 340 and the distance between the second portion 358, 360 of the walls 338, 340. In addition, a distance between the first end 342 of the receptacle 330 and the first and second conductive contact areas 378, 380 is less than a distance between the first end 342 and the first and second sacrificial contact areas 350, 352.

The first and second conductive contact areas 378, 380 extend/curve inward towards the cavity 336 and each other. In one embodiment, the conductive contact areas 378, 380 are configured to flex/pivot outwards (away from the cavity 336) as a second portion of the header 432 contacts the conductive contact areas 378, 380. In this embodiment, one or more portions of the first and second walls 338, 340 are flexible. For example, each of the first portions 354, 356, second portions 358, 360, sacrificial contact areas 350, 352 and/or the conductive contact areas 378, 380 can each be flexible and/or comprise one or more pivot points. These flexible/pivotable areas/components allow the conductive contact areas 378, 380 to flex outwards away from the cavity 336 and exert a spring-type force against a corresponding portion of the header 432. This spring-type force maintains the header 432 within the receptacle 330 while also allowing the header 432 to be removed from the receptacle 330.

The sacrificial contact areas 350, 352 of the walls 338, 340 are referred to as "sacrificial" because they are configured to be a first (initial) and temporary contact point for the header 432 and are allowed to be damaged. For example, as the header 432 is inserted/transitioned into the receptacle 330 a first portion of the header 432 contacts the sacrificial contact areas 350, 352 prior to a second portion of the header 432 contacting the conductive contact areas 378, 380. Therefore, any damage that may result from the initial voltage difference between the receptacle 330 and header 432 occurs at the sacrificial contact areas 350, 352 and not the conductive contact areas 378, 380. As the header 432 transitions further into the receptacle 330 the second portion of the header 432 contacts the conductive contact areas 378, 380 while the first portion of the header 432 is still contacting the sacrificial contact areas 350, 352. Therefore, the second portion of the header 432 is at the same voltage level as the receptacle 330, which prevents any sparking/overheating from occurring as a result of this secondary contact.

As the header 432 continues to transition into the receptacle 330 and reaches a working/resting (final) position the first portion of the header 432 no longer contacts the sacrificial contact areas 350, 352 and is situated between the first portions 354, 356 of the receptacle walls 338, 340. However, the second portion of the header 432 remains in contact with the second conductive contact areas 378, 380. Because the second portion does not remain in contact with the sacrificial contact areas 350, 352 the receptacle 330 and the header 432 are not affected by any damage that may have occurred as a result of the initial contact between. It should be noted that the distance between the sacrificial contact areas 350, 352 and the conductive contact areas 378, 380 is dimensioned such that the above contact configurations occur.

Figure 4:
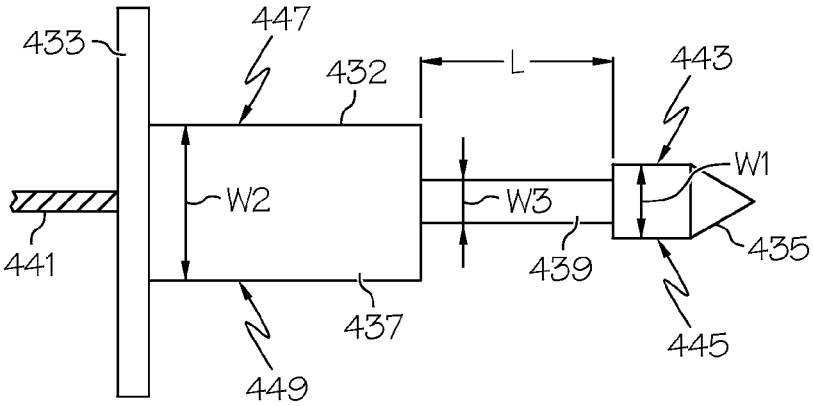
FIG. 4 is a side view of a header component of an interconnect system according to one embodiment of the present invention.

FIG. 4 is a more detailed view of the header 432. In particular, FIG. 4 shows the header 432 being coupled to or formed as part of a wall 433 of the second rigid connector 216. However, the header 432 can also be situated within a via of the connector 216 as well. In one embodiment, the header 432 comprises a first contact portion/member 435, a second contact portion/member 437, and a non-contact portion/member 439. The first and second contact portions 435, 437 are coupled together by the non-contact portion 439, which is situated therebetween. Each of these portions 435, 437, 439 comprises one or more conductive materials. The second contact portion 437 of the header 432, in one embodiment, comprises one or more conductors 441 for providing power to the component comprising the connector 216 when the header 432 engages the receptacle 330. In another embodiment, one or more conductors are coupled to the wall (and/or via) 433 of the connector 216 and second contact portion 437.

The first portion 435 (herein referred to as a "sacrificial contact portion") comprises a first sacrificial contact area 445 and at least a second sacrificial contact area 445. It should be noted that, in one embodiment, the sacrificial contact areas 443, 445 can be part of a single sacrificial contact area. The first sacrificial contact area 443 is configured to contact the first sacrificial contact area 350 of the receptacle 330 and the second sacrificial contact area 445 is configured to contact the second sacrificial contact area 352 of the receptacle 330. The second contact portion 437 (herein referred to as a "conductive contact portion") comprises a first conductive contact area 447 and at least a second conductive contact area 449. It should be noted that, in one embodiment, the conductive contact areas 447, 449 can be part of a single conductive contact area. The first conductive contact area 447 is configured to contact the first conductive contact area 378 of the receptacle 330 and the second conductive contact area 449 is configured to contact the second conductive contact area 380 of the receptacle 330.

The width W1 of the sacrificial contact portion 435 of the header 432 is smaller than the width W2 of the conductive contact portion 437. The width W1 of the sacrificial contact portion 435 of the header 432 is also smaller than the distance between the conductive contact areas 378, 380 of the receptacle 330. Therefore, the sacrificial contact portion 435 of header 432 does not contact (free of contact) the conductive contact areas 378, 380 of the receptacle 330 when the header 432 is inserted into the receptacle 330. The width W3 of the non-contact portion 439 of the header 432 is smaller than the width W1 of the sacrificial contact portion 435 and the width W2 of the conductive contact portion 437. The width W3 of the non-contact portion 439 is also smaller than the distance between the sacrificial contact areas 350, 352 and the conductive contact areas 378, 380 of the receptacle 330. Therefore, when the header 432 is transitioning into and out of the receptacle 330 the non-contact portion 439 of the header 432 does not contact any portion of the receptacle 330.

The length L of the non-contact portion 439 is dimensioned such that the sacrificial contact portion 435 of the header 432 contacts the sacrificial contact areas 350, 352 of the receptacle 330 prior to the conductive contact portion 437 of the header 432 contacting the conductive contact areas 378, 380 of the receptacle 330. The length L is also dimensioned such that the sacrificial contact portion 435 of the header 432 remains in contact with the sacrificial contact areas 350, 352 of the receptacle 330 as the conductive contact portion 437 of the header 432 initially contacts the conductive contact areas 378, 380 of the receptacle 330. However, the length L is dimensioned such that as the header 432 continues to transition into the receptacle 330 and reaches (and/or approaches) a working/resting position the sacrificial contact portion 435 of the header 432 no longer contacts the sacrificial contacts areas 350, 352 of the receptacle 330. The non-contact portion 439, at this point, is situated between the first portions 334, 336 of the walls 338, 340 and at least a part of the conductive contact portion 437 of the header 432 is situated between and contacts the conductive contact areas 378, 380 of the receptacle 330.

Figure 5:
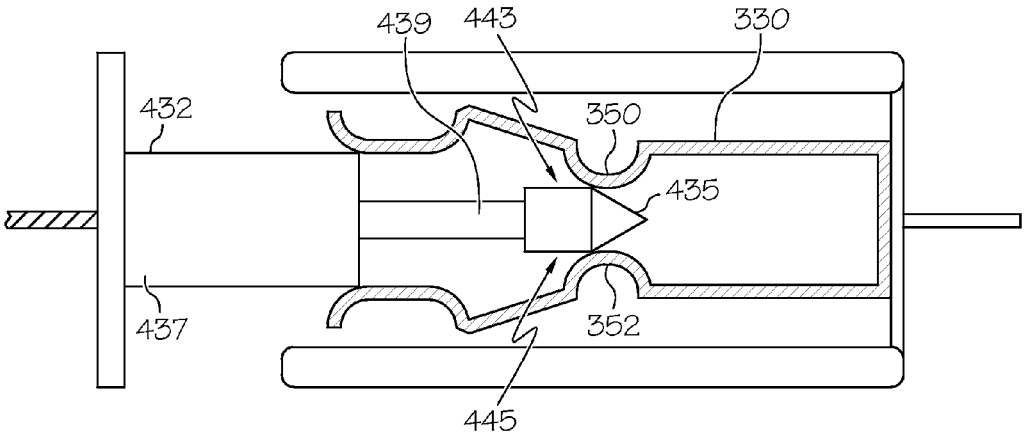
FIG. 5 illustrates a first configuration of header and receptacle components of an interconnect system when the header component has been transitioned an initial position within the receptacle component according to one embodiment of the present invention.
Figure 6:
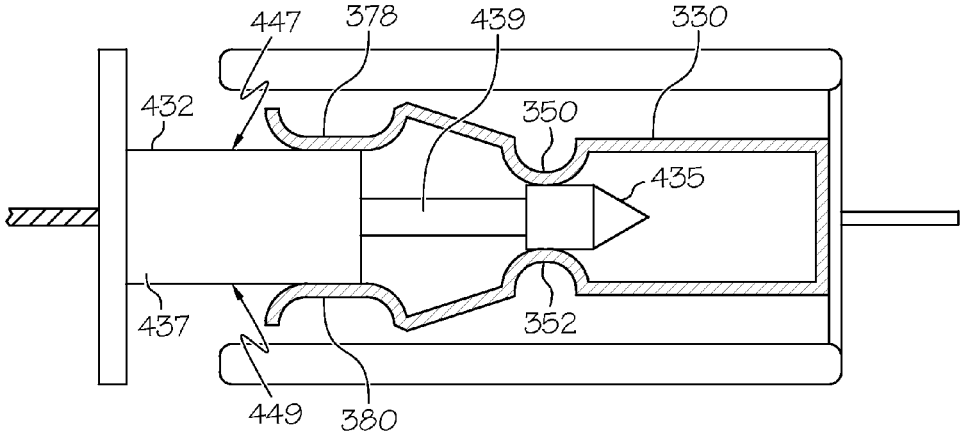
FIG. 6 illustrates a second configuration of header and receptacle components of an interconnect system when the header component has been transitioned an intermediate position within the receptacle component according to one embodiment of the present invention.
Figure 7:
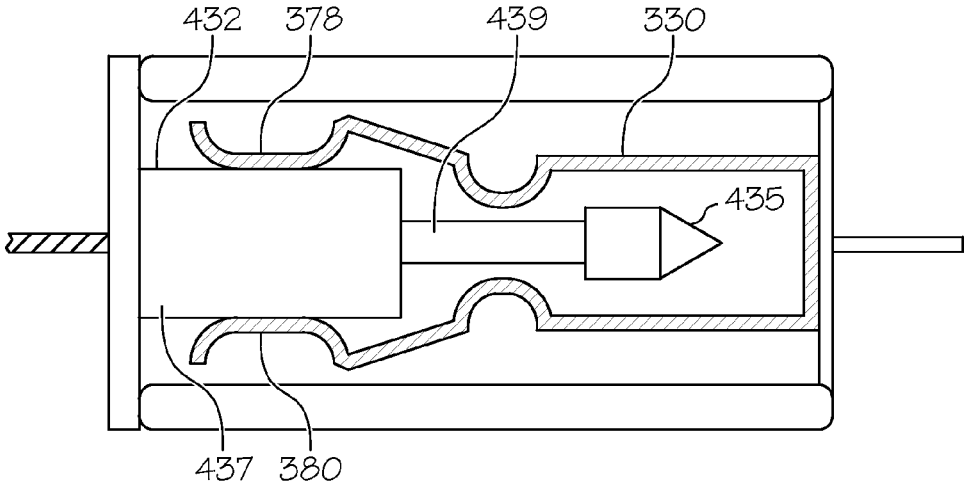
FIG. 7 illustrates a third configuration of header and receptacle components of an interconnect system when the header component has been transitioned a working position within the receptacle component according to one embodiment of the present invention.

FIGS. 5 to 7 show one example of the header 432 being transitioned into the receptacle 330. In particular, FIG. 5 shows an initial insertion configuration between the header 432 and the receptacle 330. As the header 432 is inserted into the receptacle 330, the sacrificial contact portion 435 of the header 432 makes the initial contact with the receptacle 330. For example, the sacrificial contact areas 443, 445 of the sacrificial contact portion 435 contact the sacrificial contact areas 350, 352 of the receptacle 330. The sacrificial contact portion 435 does not contact the conductive contact areas 378, 380 of the receptacle 330 since the width W1 of the sacrificial contact portion 435 is less than the distance between the first and second conductive contact areas 378, 380 of the receptacle 330. FIG. 5 also shows that as the sacrificial contact portion 435 of the header 435 makes the initial contact with the receptacle 330 the conductive contact portion 437 (and the non-contact portion 439) of the header 432 does not contact any portion of the header 432. Therefore, any sparks, overheating, burning, etc. resulting from this initial contact only occur at the sacrificial contact areas of the header 432 and receptacle 330.

FIG. 6 shows an intermediate insertion configuration as the header 432 is transitioned further into the receptacle 330. In this position, the conductive contact portion 437 makes secondary contact with the receptacle 330 while the sacrificial contact portion 435 remains in contact with the sacrificial contact areas 378, 380 of the receptacle 330. Since the header 432 and the receptacle 330 are at the same voltage level as a result of the initial contact shown in FIG. 5 sparking and/or overheating does not occur between the conductive contact portion 437 of the header 432 and the conductive contact areas 378, 380 of the receptacle 330.

FIG. 7 shows a working/resting position between the header 432 and the receptacle 330. This is the position that the header 432 is maintained within the receptacle 330 during normal working conditions. As can be seen, as the header 432 transitions into this position the sacrificial contact portion 435 of the header 432 disengages the sacrificial contact areas 350, 352 of the receptacle 330. The sacrificial contact portion 435 is then situated between the first portion 354, 356 of the receptacle walls 338, 340. A region of the non-contacting portion 439 of the header is situated between the sacrificial contact areas 350, 352 when the header is in this working/resting position. However, because the width W3 of the non-contacting portion 439 of the header 432 is less than the distance between the sacrificial contact areas 350, 352 of the receptacle 330 the non-contacting portion 439 does not contact the sacrificial contact areas 350, 352 of the receptacle 330. Also, the conductive contact portion 437 of the header 432 remains in contact with the conductive contact areas 378, 380 while the header 432 is in the position shown in FIG. 7. The conductive contact areas 378, 380 exert a force against the conductive contact areas 378, 380 thereby maintaining the header 432 within the receptacle. It should be noted that the above discussion also applies to the removal of the header 432 from the receptacle 330.

As can be seen from the above discussion, one or more embodiments provide a dual level contact (e.g., sacrificial and conductive contact areas) interconnect system. The embodiments of the present invention significantly prolongs the life of the interconnection system as the conductive contact areas do not get damaged from sparks from the insertion and extraction of the header. Also, one or more embodiments ensure the proper resistance at working condition because damage is preventing from occurring at the conductive area. This greatly reduces the risk of burning since the sacrificial area is not in contact with the receptacle in normal working conditions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A receptacle for a power interconnect system comprising:

a first conductive wall;

at least a second conductive wall situated opposite the first conductive wall;

a first end and a second end situated opposite the first end, wherein the first end is configured to receive a corresponding header of a connector;

a first sacrificial contact area situated on the first conductive wall;

at least a second sacrificial contact area situated on the second conductive wall and opposite the first sacrificial contact area;

a first conductive contact area situated on the first conductive wall; and at least a second conductive contact area situated on the second conductive wall and opposite the first conductive contact area, wherein a distance between the first end and the first and second conductive contact areas is less than a distance between the first end and the first and second sacrificial contact areas, and wherein the first and second sacrificial contact areas are configured to contact a sacrificial portion of the header prior to a conductive portion of the header contacting the first and second conductive contact areas.

2. The receptacle of claim 1, wherein the first conductive wall and second conductive wall are electrically coupled to a power supply.

3. The receptacle of claim 1, wherein a distance between the first and second sacrificial contact areas is less than a distance between the first and second conductive contact areas.

4. The receptacle of claim 1, wherein the first and second conductive contact areas are configured to exert a force against the header.

5. The receptacle of claim 1, wherein the first and second conductive contact areas and the first and second sacrificial contact areas are configured to contact the header when the header is transitioned to an intermediate position between the first conductive wall and the second conductive wall.

6. The receptacle of claim 1, wherein the first and second conductive contact areas contact the header and the first and second sacrificial contact areas are free from contact with the header when the header is transitioned to a working position between the first conductive wall and the second conductive wall.

7. The receptacle of claim 1, wherein an angled portion of the first conductive wall is situated between the first sacrificial contact area and the first conductive contact area, and wherein an angled portion of the second conductive wall is situated between the second sacrificial contact area and the second conductive contact area.

8. A header for a power interconnect system comprising:

a first portion comprising a first width;

a second portion comprising a second width; and a third portion situated between the first and second portions, and comprising a third width, wherein the first width is less than the second width and greater than the third width, wherein the third width is less than the first width and the second width, wherein the first portion is configured to contact a first contact area of a receptacle of a connector prior to the second portion contacting a second contact area of the receptacle, wherein the first contact area of the receptacle is situated further from an opening of the receptacle than the second contact area.

9. An interconnect system for power applications, the interconnect system comprising:

at least one header; and at least one receptacle configured to engage the at least one header, wherein the header comprises
a first portion;
a second portion; and
a third portion situated between the first and second portions,
wherein the receptacle comprises
a first conductive wall;
at least a second conductive wall situated opposite the first conductive wall;
a first end and a second end situated opposite the first end, wherein the first end is configured to receive the header;
a first sacrificial contact area situated on the first conductive wall;
at least a second sacrificial contact area situated on the second conductive wall and opposite the first sacrificial contact area;
a first conductive contact area situated on the first conductive wall; and
at least a second conductive contact area situated on the second conductive wall and opposite the first conductive contact area,
wherein the first portion of the header is configured to contact the first and second sacrificial contact areas of the receptacle prior to the second portion of the header contacting the first and second conductive contact areas, wherein a distance between the first end and the first and second conductive contact areas is less than a distance between the first end and the first and second sacrificial contact areas.

10. The interconnect system of claim 9, wherein the first portion of the header comprise a first width, the second portion comprises a second width, and the third portion comprises a third width,
wherein the first width is less than the second width and greater than the third width, and wherein the third width is less than the first width and the second width.

11. The interconnect system of claim 9, wherein the first portion of the header is configured to contact the first and second sacrificial contact areas of the receptacle while the second portion of the header contacts the first and second conductive contact areas of the receptacle.

12. The interconnect system of claim 9, wherein the first portion of the header is configured to be free of contact with the first and second sacrificial contact areas of the receptacle while the second portion of the header contacts the first and second conductive contact areas of the receptacle.

13. The interconnect system of claim 9, wherein the receptacle is electrically coupled to a power supply.

14. The interconnect system of claim 9, wherein the header is electrically coupled to a power supply.

15. The interconnect system of claim 9, wherein a distance between the first and second sacrificial contact areas is less than a distance between the first and second conductive contact areas.

16. The interconnect system of claim 9, wherein the first and second conductive contact areas are configured to exert a force against the header.

17. The interconnect system of claim 9, wherein the receptacle further comprises:
an angled portion of the first conductive wall is situated between the first sacrificial contact area and the first conductive contact area; and
an angled portion of the second conductive wall is situated between the second sacrificial contact area and the second conductive contact area.

18. An interconnect system for power applications, the interconnect system comprising:
at least one connector comprising a housing, wherein the housing includes at least one receptacle, and wherein the receptacle comprises
a first conductive wall;
at least a second conductive wall situated opposite the first conductive wall;
a first end and a second end situated opposite the first end, wherein the first end is configured to receive a corresponding header of a connector;
a first sacrificial contact area situated on the first conductive wall;
at least a second sacrificial contact area situated on the second conductive wall and opposite the first sacrificial contact area;
a first conductive contact area situated on the first conductive wall; and
at least a second conductive contact area situated on the second conductive wall and
opposite the first conductive contact area,
wherein a distance between the first end and the first and second conductive contact areas is less than a distance between the first end and the first and second sacrificial contact areas, and
wherein the first and second sacrificial contact areas are configured to contact a sacrificial portion of the header prior to a conductive portion of the header contacting the first and second conductive contact areas.

19. The interconnect system of claim 18, wherein a distance between the first and second sacrificial contact areas is less than a distance between the first and second conductive contact areas.

20. The interconnect system of claim 18, further comprising:
at least one additional connector comprising a housing, wherein the housing comprises at least one header, and wherein the header comprises:
wherein the header comprises
a first portion;
a second portion; and
a third portion situated between the first and second portions.

21. The interconnect system of claim 20, wherein the first portion of the header comprise a first width, the second portion comprises a second width, and the third portion comprises a third width,
wherein the first width is less than the second width and greater than the third width, and wherein the third width is less than the first width and the second width.

22. The interconnect system of claim 20, wherein the first and second sacrificial contact areas of the receptacle are configured to contact the first portion of the header prior to the first and second conductive contact areas contacting the second portion of the header.

23. The interconnect system of claim 20, wherein the first and second sacrificial contact areas of the receptacle are configured to contact the first portion of the header while the first and second conductive contact areas of the receptacle are in contact with the second portion of the header.

24. The interconnect system of claim 20, wherein the first and second sacrificial contact areas of the receptacle are configured to be free from contact with first portion of the header while the first and second conductive contact areas are in contact with the second portion of the header.

25. The interconnect system of claim 20, wherein one of the receptacle and the header is electrically coupled to a power supply.

* * * * *